US009129731B2

(12) United States Patent
Komuro et al.

(10) Patent No.: US 9,129,731 B2
(45) Date of Patent: Sep. 8, 2015

(54) SINTERED MAGNET

(75) Inventors: Matahiro Komuro, Hitachi (JP); Yuichi Satsu, Hitachi (JP); Isao Kitagawa, Kokubunji (JP); Akira Sugawara, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 591 days.

(21) Appl. No.: 13/572,812

(22) Filed: Aug. 13, 2012

(65) Prior Publication Data

US 2013/0069746 A1 Mar. 21, 2013

(30) Foreign Application Priority Data

Sep. 21, 2011 (JP) ..... 2011-205491

(51) Int. Cl.
*H01F 7/02* (2006.01)
*H01F 1/01* (2006.01)
*H01F 1/057* (2006.01)

(52) U.S. Cl.
CPC ..... *H01F 1/0572* (2013.01); *H01F 1/0579* (2013.01); *H01F 1/0577* (2013.01)

(58) Field of Classification Search
CPC ..... H01F 1/057; H01F 1/0577
See application file for complete search history.

(56) References Cited

U.S. PATENT DOCUMENTS

| | | | |
|---|---|---|---|
| 2008/0054738 | A1 | 3/2008 | Komuro et al. |
| 2010/0141367 | A1 | 6/2010 | Komuro et al. |
| 2011/0254646 | A1 | 10/2011 | Komuro et al. |

FOREIGN PATENT DOCUMENTS

| | | | |
|---|---|---|---|
| JP | 2001-68319 | A | 3/2001 |
| JP | 2001-274016 | A | 10/2001 |
| JP | 2006-128535 | A | 5/2006 |
| JP | 2007-294917 | A | 11/2007 |
| JP | 2008-60183 | A | 3/2008 |
| JP | 2010-74062 | A | 4/2010 |

*Primary Examiner* — Jessee Roe
(74) *Attorney, Agent, or Firm* — Crowell & Moring LLP

(57) ABSTRACT

Disclosed is a sintered magnet which is a rare-earth magnet using a less amount of a rare-earth element but having a higher maximum energy product and a higher coercivity. The sintered magnet includes a NdFeB crystal; and an FeCo crystal adjacent to the NdFeB crystal through the medium of a grain boundary. The FeCo crystal includes a core and a periphery and has a cobalt concentration decreasing from the core to the periphery. The FeCo crystal has a difference in cobalt concentration of 2 atomic percent or more between the core and the periphery. In the NdFeB crystal, cobalt and a heavy rare-earth element are unevenly distributed and enriched in the vicinity of the grain boundary.

8 Claims, 3 Drawing Sheets

SINTERED MAGNET

CLAIM OF PRIORITY

The present application claims priority from Japanese Patent application Ser. No. 2011-205491, filed on Sep. 21, 2011, the content of which is hereby incorporated by reference into this application.

BACKGROUND OF THE INVENTION

1. Field of the Invention

The present invention relates to a sintered magnet which contains FeCo crystals having a high saturation flux density and contains a heavy rare-earth element unevenly distributed.

2. Description of Related Art

Japanese Unexamined Patent Application Publication (JP-A) No. 2010-74062 discloses a nanocomposite magnet including an iron-cobalt (FeCo) soft magnetic phase and neodymium-iron-boron (NdFeB) being composited with each other, but this literature does not refer to a sintered magnet. JP-A No. 2008-60183 discloses a FeCo ferromagnetic powder coated with a fluoride, but this literature does not refer to the cobalt composition of FeCo crystals. JP-A No. 2006-128535 describes the atomic ratio between cobalt and Fe in a magnetic powder containing Fe and Co, but does not refer to an NdFeB sintered magnet. JP-A No. 2001-68319 discloses a ferrite magnet having a microstructure containing cobalt unevenly distributed, but does not refer to an NdFeB sintered magnet. JP-ANo. 2001-274016 discloses a rare-earth alloy film magnet having a periodically varying concentration of a specific element in the magnet, but does not refer to FeCo crystals. JP-ANo. 2007-294917 discloses a sintered magnet containing a heavy rare-earth element being unevenly distributed and enriched at peripheries of crystal grains, but lacks description about FeCo crystals.

These customary techniques, however, do not give magnets having a maximum energy product higher than the theoretical maximum energy product (64 MGOe) of $Nd_2Fe_{14}B$ and fail to provide a high-density magnet which allows both improvement in the maximum energy product and reduction in amount of a rare-earth element. The technique of unevenly distributing a heavy rare-earth element in an NdFeB magnet, when employed alone, does not contribute to the reduction in amount of a rare-earth element. The technique of mixing with a soft magnetic powder and sintering the resulting mixture results in a magnet having an insufficient coercivity and remarkably inferior heat resistance or resistance to demagnetization.

SUMMARY OF THE INVENTION

The present invention provides a sintered magnet which includes a NdFeB crystal; and an FeCo crystal adjacent to the NdFeB crystal through the medium of a grain boundary, in which the FeCo crystal includes a core and a periphery and has a cobalt concentration decreasing from the core to the periphery, the FeCo crystal has a difference in cobalt concentration of 2 atomic percent or more between the core and the periphery, and cobalt and a heavy rare-earth element are unevenly distributed in the NdFeB crystal and enriched in the vicinity of the grain boundary.

The present invention satisfactorily gives a rare-earth permanent magnet using a rare-earth element in a smaller amount, having a higher coercivity, and having a larger maximum energy product. This reduces the amount of the magnet to be used and contributes to reduction in size and weight of all products to which such magnet is applied.

DETAILED DESCRIPTION OF THE PREFERRED EMBODIMENTS

Figure 1:
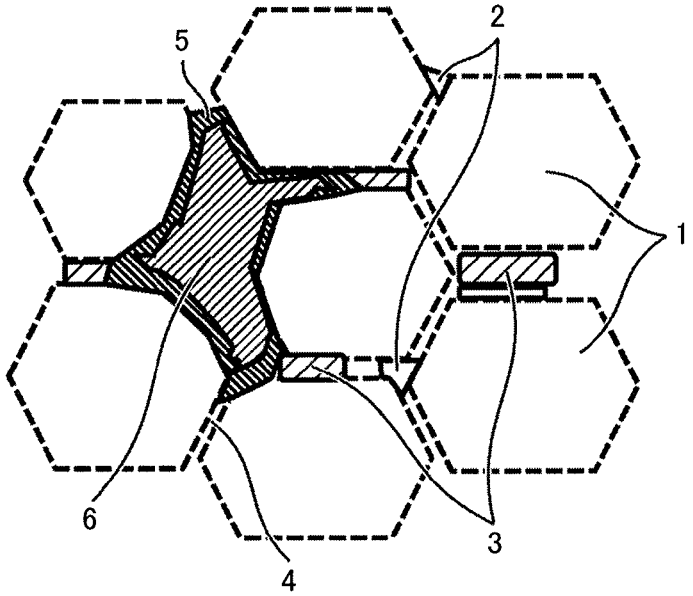
FIG. 1 depicts a structure (1) of a sintered magnet according to an embodiment of the present invention.

Permanent magnets using rare-earth elements such as rare-earth-iron-boron permanent magnets typified by $Nd_2Fe_{14}B$ sintered magnets are used in magnetic circuits of various kinds. Permanent magnets used in environments at a high temperature or in a large magnetization field should essentially contain a heavy rare-earth element. Reduction in amounts of rare-earth elements including heavy rare-earth elements is a very important issue from the viewpoint of conservation of global resource. It is difficult, however, to apply customary techniques to this issue, because magnets according to the customary techniques are decreased in either maximum energy product or coercivity when using a smaller amount of a rare-earth element. Accordingly, an object of the present invention is to provide a magnet using a rare-earth element in a smaller amount, having a higher coercivity, and having a larger maximum energy product.

To achieve the object, a composite of an FeCo crystal and a NdFeB crystal is sintered. The FeCo crystal has a saturation flux density higher than that of the NdFeB crystal. Since the FeCo crystal easily undergoes magnetization reversal, the FeCo crystal is magnetically coupled with the NdFeB crystal to suppress the magnetic reversal. To obtain such magnetic coupling, the NdFeB crystal which is present adjacent to the FeCo crystal through the medium of a grain boundary should have a higher magnetocrystalline anisotropy energy, and the FeCo crystal in the vicinity of the grain boundary should have a lower magnetocrystalline anisotropy energy. Here, the FeCo crystal mainly contains Fe and Co, that is, the FeCo crystal has a total concentration of Fe and Co by 50 atomic percent or high. And the NdFeB crystal mainly contains Nd, Fe and B, that is, the NdFeB crystal has a total concentration of Nd, Fe and B by 50 atomic percent or high.

The FeCo crystal has a saturation magnetization higher than that of $Nd_2Fe_{14}B$ and has a saturation flux density of 1.5 T or more and less than 2.8 T. The FeCo crystal may have any composition not limited and may contain any of rare-earth elements, metalloid elements and metal elements, as long as having the saturation flux density within this range. The FeCo crystal can have a higher remnant flux density through a magnetic coupling with $Nd_2Fe_{14}B$ crystal grains, as having the saturation flux density higher than that of $Nd_2Fe_{14}B$. The FeCo crystal and the $Nd_2Fe_{14}B$ crystal are adjacent to each other through the medium of a phase enriched in a heavy rare-earth element (grain boundary). The phase enriched in the heavy rare earth element contains fluorine, oxygen and carbon.

A sintering aid is used to allow a liquid phase to be present in a sufficient amount at a sintering temperature, to increase wettability between the liquid phase and FeCo crystal grains or $Nd_2Fe_{14}B$ crystal grains, and to allow a sintered magnet to have a higher density after sintering. A fluorine-containing phase easily reacts with a phase having a high rare-earth element concentration, resulting in reduction in amount of the liquid phase. This causes the sintered compact to have a lower density and a smaller coercivity. For suppressing such reduction in density and coercivity, a sintering aid such as an Fe-70% Nd alloy powder is added.

In addition, a magnetic field is applied in a direction perpendicular to a magnetic field in pressing upon sintering. This allows effects of the application of the magnetic field to exhibit at temperatures in such a range where only the FeCo crystal has magnetization, thus imparting magnetic anisotropy to the FeCo crystal. Upon quenching after sintering, a magnetic field is applied in a direction in parallel with the forming magnetic field. This increases exchange coupling between the FeCo crystal grains and the $Nd_2Fe_{14}B$ crystal grains. Thus, the application of magnetic fields contributes to increased coercivity and more satisfactory squareness.

For unevenly distributing the heavy rare-earth element, production of the magnet employs a treatment with a fluoride solution. A solution to be used in the fluoride solution treatment contains an anionic component in an amount on the order of 100 ppm or less. When a material containing a large amount of a rare-earth element is treated with the solution, the anionic component in the solution corrodes or oxidizes part of the surface of the material. The sintered magnet according to the present invention employs at least two different ferromagnetic alloys, i.e., NdFeB crystal and FeCo crystal, in which the FeCo crystal having good corrosion resistance is employed as the material to be subjected to the fluoride solution treatment so as to prevent corrosion and oxidization caused by the treatment. In the FeCo crystal, a rare-earth element, particularly, a heavy rare-earth element is preferably unevenly distributed and enriched in the vicinity of the grain boundary so as to contribute to an increased coercivity and a reduced amount of rare-earth elements to be used, because the FeCo crystal generally has a small coercivity.

From the viewpoints as mentioned above, means to achieve the object are collectively indicated as follows. [1] The FeCo crystal has a cobalt concentration decreasing from the core to the periphery and being low particularly in the vicinity of the grain boundary. As used herein the term "periphery" in a crystal refers to a region of the crystal ranging from the surface to about 1 nm deep toward the core. [2] The FeCo crystal has a difference in cobalt concentration of 2 atomic percent or more between the core and the periphery. [3] The NdFeB crystal contains cobalt and a heavy rare-earth element being enriched in the vicinity of the grain boundary. [4] The FeCo crystal has a saturation flux density higher than that of the NdFeB crystal.

The grain boundary between the FeCo crystal and the NdFeB crystal has a width of preferably less than 10 nm and particularly preferably from 0.1 to 2 nm. If the grain boundary has a width of 10 nm or more, the resulting magnet may have a lower coercivity. Because such grain boundary having an excessively large width may cause reduction in the magnetic coupling between adjacent crystals. In contrast, a grain boundary having a width of less than 0.1 nm may not sufficiently contribute to uneven distribution of a heavy rare-earth element, and this may cause the magnet to have a lower coercivity.

To provide a magnet having the aforementioned characteristics, the magnet may be produced by 1) subjecting the FeCo crystal to a treatment with a heavy rare-earth fluoride solution, mixing the treated FeCo crystal with the NdFeB crystal and a sintering aid, and subjecting the mixture to magnetic field orientation (magnetic field pressing); and 2) the magnetic field orientation, subjecting the resulting material to a quenching treatment in a magnetic field upon a sintering heat treatment thereafter so as to suppress mutual diffusion between the FeCo crystal and the NdFeB crystal and to impart the magnetic coupling at the boundary.

A sintered magnet in the present invention includes a NdFeB crystal; an FeCo crystal; and a grain boundary region disposed between the NdFeB crystal and the FeCo crystal, in which the FeCo crystal has a cobalt concentration decreasing from a center to an interface by 2 atomic percent or more, and in which the NdFeB crystal contains cobalt and a heavy rare-earth element, and has concentrations of the cobalt and the heavy rare-earth element increasing from a center to an interface.

In the sintered magnet, the FeCo crystal preferably includes a body-centered cubic structure or a body-centered tetragonal structure.

In the sintered magnet, the FeCo crystal preferably has a saturation flux density higher than the saturation flux density of the NdFeB crystal.

In the sintered magnet, the grain boundary region preferably has a width of 0.1 to 2 nm.

In the sintered magnet, the grain boundary region preferably includes an acid fluoride.

In the sintered magnet, the heavy rare-earth element is preferably enriched at the grain boundary region.

In the sintered magnet, the NdFeB crystal preferably has a degree of orientation higher than the FeCo crystal.

The sintered magnet is preferably prepared through quenching in a magnetic field at a cooling rate of 10° C./second or more in a heat treatment process upon sintering.

Hereinafter, the sintered magnet in the present invention is explained by using Examples.

Example 1

Particles of an alloy containing 70% of iron and 30% of cobalt are prepared by gas atomizing so as to have an average particle size of 1 μm, and mixed with a TbF alcohol solution to form a TbF film thereon. The TbF film has an average film thickness of 10 nm. The resulting TbF-coated 70% Fe-30% Co alloy particles are mixed with a $Nd_2Fe_{14}B$ powder having an average particle size of 1 μm in a solvent without being exposed to the atmosphere. Upon mixing, an organic dispersing agent is added in an amount of 0.1%. The TbF-coated 70% Fe-30% Co alloy particles are used in an amount of 20% with respective to the $Nd_2Fe_{14}B$ powder. The use of the dispersing agent prevents the aggregation of the 70% Fe-30% Co alloy particles and enables compact molding in a magnetic field. The TbF film has a composition of $TbF_{1-3}$, which further contains oxygen and carbon in an amount of from 0.1% to 40%. A green compact (molded article) compacted in a magnetic field includes the 70% Fe-30% Co alloy particles being substantially uniformly dispersed. The green compact is heated to 1100° C., sintered, cooled while a magnetic field is applied thereto, and thereby yields a sintered compact including $Nd_2Fe_{14}B$ crystal grains; and, adjacent thereto, 70% Fe-30% Co alloy particles being dispersed. The application of a magnetic field after sintering is performed by applying a magnetic field of 2 T at temperatures in the range of from 1100° C. to 320° C. in a direction equal to the direction of the magnetic field applied upon magnetic-field compact molding before sintering. The sintered compact is subjected to aging in a magnetic field and quenched (rapidly cooled). Such quenching in a magnetic field allows the resulting sintered compact to have a maximum energy product larger by 5% to 50% than that of a sintered compact prepared through cooling in the absence of a magnetic field. The resulting sintered compact has, as magnetic properties, a remnant flux density of 1.7 T, a coercivity of 25 kOe, and a maximum energy product of 70 MGOe.

To exhibit such a maximum energy product equal to or higher than the theoretical maximum energy product of $Nd_2Fe_{14}B$, a sintered compact should satisfy at least one of the following conditions.

1) A ferromagnetic main phase includes $Nd_2Fe_{14}B$ and FeCo crystals.

2) Part of the grain boundary of the FeCo crystal is in contact with a NdOF acid fluoride.

3) In the vicinity of the grain boundary of the FeCo crystal, the $Nd_2Fe_{14}B$ compound has an increased cobalt concentration, or the FeCo crystal has a decreased cobalt concentration.

4) FeCo crystals include a crystal containing terbium.

5) A rare-earth-iron compound having a fcc structure grows in part of grain-boundary triple junctions, and a NdOF compound, a CoFeO compound, or a $Nd_2O_3$ compound is observed.

6) The $Nd_2Fe_{14}B$ compound in the vicinity of the FeCo crystal has a terbium concentration higher than the average terbium concentration of the entire sintered compact.

7) Cooling in a magnetic field increases exchange coupling between the FeCo crystal and $Nd_2Fe_{14}B$ compound crystal, and this improves squareness of a demagnetization curve. In addition, the FeCo crystal has a shape extending in a direction of the magnetic field, thereby has increased shape anisotropy, and this also increases the squareness of the demagnetization curve. The application of the magnetic field exhibits significant effects at a temperature higher than a Curie temperature of the $Nd_2Fe_{14}B$ compound, and the application of the magnetic field may not exhibit sufficient effects if it is less than 0.1 T. The application of a magnetic field at a temperature equal to or lower than the Curie temperature of the FeCo crystal allows crystalline or atomic rearrangement of the FeCo crystal to proceed in the direction of the magnetic field, and this allows the FeCo crystal to have such anisotropy as to show high magnetization in a direction in parallel to the direction of the magnetic field. The anisotropy of the FeCo crystal affects the magnetic properties of the sintered magnet, and the magnet has an increasing maximum energy product with an increasing magnetic anisotropy of the FeCo crystal.

Satisfying the above conditions may give the following advantageous effects.

1) The FeCo crystal has a saturation magnetization higher than that of $Nd_2Fe_{14}B$, and the magnetic coupling between the two phases thereby increases the remnant flux density. The FeCo crystal should contain cobalt in a concentration of from 0.1% to 95%. Even an FeCo crystal further containing any of metal elements other than iron and cobalt or metalloid elements can serve to increase the maximum energy product, as long as having a saturation magnetization higher than that of $Nd_2Fe_{14}B$. A ferrimagnetic phase of a metal, an oxide or an acid fluoride is preferably present around the FeCo crystal in a thickness of from 1 to 100 nm on average. This may increase the coercivity by 1 to 5 kOe.

2) The acid fluoride suppresses the reaction of the FeCo crystal with the liquid phase upon sintering, thus prevents the disappearance of bcc phase having a high saturation magnetization due to the reaction with the $Nd_2Fe_{14}B$ compound, and also prevents the coarsening of crystal grains of the $Nd_2Fe_{14}B$ compound. The X-ray diffraction pattern of the sintered compact demonstrates the presence of a bcc (body-centered cubic) structure, in addition to a tetragonal structure derived from the $Nd_2Fe_{14}B$ compound. In a selected-area electron diffraction image, there is observed a diffraction pattern of a fluoride or acid fluoride in part of grain boundaries. Grains of the $Nd_2Fe_{14}B$ compound have uniformly aligned c-axis directions on average, and the sintered magnet can have more satisfactory magnetic properties with increasing c-axis orientation. The body-centered cubic crystal as a phase having a high saturation magnetization has an orientation lower than that of the tetragonal crystal having c-axis orientation. This is because such body-centered cubic crystal grains have particle sizes smaller than those of tetragonal crystals, are thereby susceptible to aggregation upon molding and sintering, and are difficult to have uniformized orientations due to small magnetocrystalline anisotropy. However, the application of a magnetic field of 20 kOe or more in the sintering process and in the aging process allows the bcc crystal to have the <100> direction being more oriented to the c-axis direction of the tetragonal crystal than that in a sintered magnet prepared without magnetic field application.

3) At the boundary between the FeCo crystal and the $Nd_2Fe_{14}B$ compound, diffusion between the two phases is observed. Specifically, cobalt diffuses from the vicinity of the grain boundary in the FeCo crystal into the $Nd_2Fe_{14}B$ compound; and terbium also diffuses into the $Nd_2Fe_{14}B$ compound. In the vicinity of the boundary between the FeCo crystal and the $Nd_2Fe_{14}B$ compound, an Fe-rich phase is observed near to the FeCo crystal; whereas a Co- or Tb-diffused phase is observed near to the $Nd_2Fe_{14}B$ compound. $(Nd, Tb)_2$ $(Fe, Co)_{14}B$ and $Fe_{80}Co_{20}$ are formed, and such $Nd_2Fe_{14}B$ compound containing cobalt and terbium has an increased Curie temperature and has a higher magnetocrystalline anisotropy energy with the c-axis direction serving as an easily-magnetizable direction. The similar advantageous effects are obtained upon the use of Dy, Ho, Pr or Sm, or two or more different rare-earth elements instead of terbium.

4) The acid fluoride having a cubic or face-centered cubic structure grows at grain-boundary triple junctions or at grain boundaries between two grains and increases the lattice matching in the vicinity of grain boundary interfaces. Such acid fluoride or oxide having a high melting point suppresses the reaction between FeCo and the $Nd_2Fe_{14}B$ compound. An amorphous phase is formed in part of grain boundaries.

5) The Tb-containing fluoride or acid fluoride formed as a result of the solution treatment prevents the reaction of the FeCo crystal during the sintering heat treatment, and terbium diffuses together with cobalt into a portion near to the $Nd_2Fe_{14}B$ compound during sintering. Thus, the sintered magnet has an increased energy product for the following reasons. Specifically, the $Nd_2Fe_{14}B$ compound crystal contains a heavy rare-earth element and cobalt being unevenly distributed; the FeCo crystal includes a phase having a low cobalt concentration and an acid fluoride each formed therein; and the $Nd_2Fe_{14}B$ compound crystal containing the heavy rare-earth element and cobalt being unevenly distributed is magnetically coupled with the FeCo crystal containing the phase having a low cobalt concentration. The low-Co-concentration phase is a bcc (body-centered cubic crystal) having a cobalt concentration lower than the average cobalt concentration of the FeCo crystal by 1% to 50% but still maintains lattice matching with crystals having the average cobalt concentration. It is acceptable that inevitably contaminated elements such as carbon, nitrogen and oxygen be unevenly distributed and enriched in part of crystal grains or at part of grain boundaries. It is also acceptable that elements constituting the $Nd_2Fe_{14}B$ compound crystal or elements added and enriched in the vicinity of grain boundaries migrate into the FeCo crystal within ranges maintaining the bcc structure.

Instead of the FeCo crystal, alloys having a saturation flux density equal to or higher than that of the main phase may be used which are typified by Fe-rare-earth element alloys, Fe—Co-rare-earth element alloys, Fe—Co—Ni-rare-earth element alloys, and Fe—M alloys where M represents one or more transition elements other than Fe or one or more metalloid elements. Instead of the TbF film used in this example, the sintered compact (sintered magnet) may employ any of fluorides of rare-earth elements; fluorides of alkaline-earth elements; oxides, nitrides, carbides, borides, silicides, chlorides and sulfides containing rare-earth elements; and composite compounds of them. The sintered compact can have a higher remnant flux density by allowing a compound corresponding to any of these compounds, except for further containing at least one element constituting the main phase, to be formed at grain boundaries adjacent to crystal grains of the material having a high saturation flux density. The fluoride has a reduction action and a magnetization increasing activity both on the phase having a high saturation flux density and on the phase having a high coercivity and is usable as an optimal compound. The $Nd_2Fe_{14}B$ compound may contain two or more rare-earth elements, and may contain one or more elements selected typically from Cu, Al, Zr, Ti, Nb, Mn, V, Ga, Bi and Cr for higher coercivity.

Figure 2:
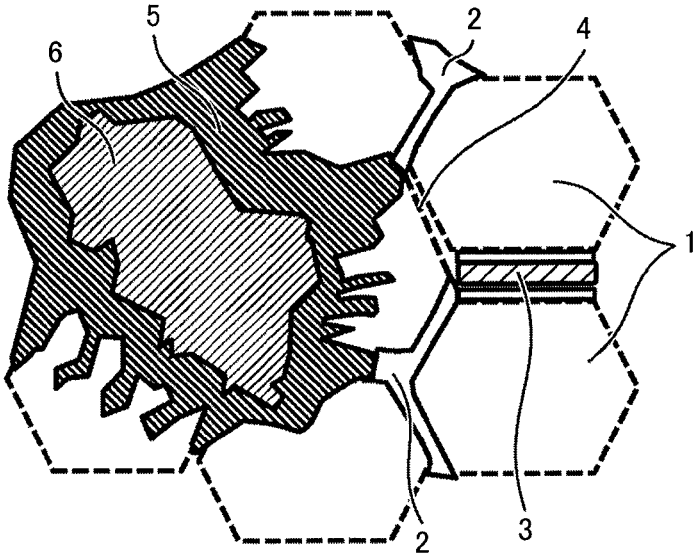
FIG. 2 depicts a structure (2) of a sintered magnet according to another embodiment of the present invention.
Figure 3:
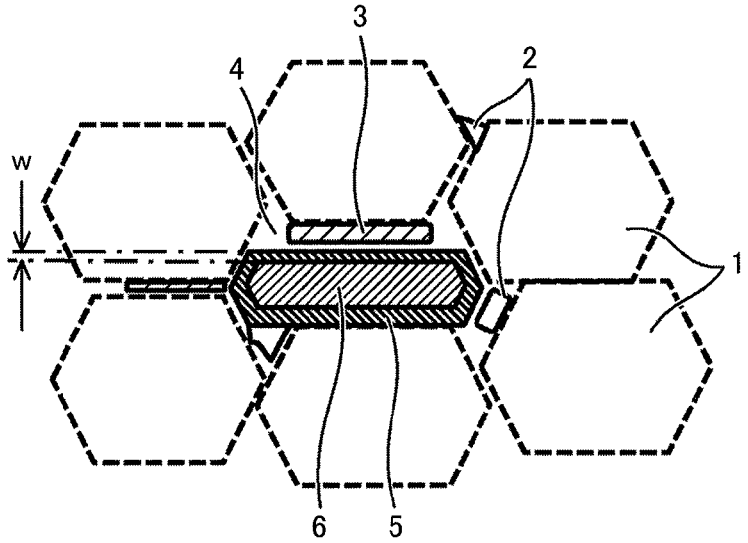
FIG. 3 depicts a structure (3) of a sintered magnet according to yet another embodiment of the present invention.

Typical structures according to this example are illustrated in FIG. 1, FIG. 2 and FIG. 3. Though varying depending typically on the particle sizes of material powders, mixing conditions, molding (compact molding) conditions, sintering conditions, and aging conditions, the structures have the following characteristics in common.

[1] The FeCo crystal has a cobalt concentration decreasing from the core to the periphery.

[2] The FeCo crystal has a difference in cobalt concentration of 2 atomic percent or more between the core and the periphery.

[3] Cobalt and a heavy rare-earth element are unevenly distributed in the NdFeB crystal and enriched in the vicinity of the grain boundary.

The FeCo crystal has a difference in cobalt concentration of preferably from 2 to 30 atomic percent. An FeCo crystal having a difference in cobalt concentration of less than 1 atomic percent may cause the sintered magnet to have a coercivity of less than 10 kOe and to be susceptible to demagnetization. An FeCo crystal having a difference in cobalt concentration of more than 50 atomic percent or more may not be obtained through a sintering process.

In the structure illustrated in FIG. 1, a $Nd_2Fe_{14}B$ crystal 1 and an FeCo crystal (including an Fe-rich phase 5 and a Co-rich phase 6) are adjacent to each other through the medium of grain boundaries 4. In some part, the $Nd_2Fe_{14}B$ crystal 1 and the FeCo crystal are in direct contact with each other without the medium of the grain boundaries 4. Whether the $Nd_2Fe_{14}B$ crystal 1 and the FeCo crystal are adjacent to each other through the medium of the grain boundary 4 or not does not significantly affect the magnetic properties. Part of the grain boundary 4 includes a heavy rare-earth-containing oxide 2 and an acid fluoride 3. Herein, the "Fe-rich phase" has an iron concentration larger than $Nd_2Fe_{14}B$ of a main phase, and has a different crystal structure and a different lattice constant from the $Nd_2Fe_{14}B$. And the "Co-rich phase" has a cobalt concentration larger than $Nd_2(Fe, Co)_{14}B$, and has a different crystal structure and a different lattice constant from the $Nd_2(Fe, Co)_{14}B$.

In the $Nd_2Fe_{14}B$ crystal 1, cobalt is enriched in the vicinity of the grain boundary. This is because cobalt diffuses from the FeCo crystal to the $Nd_2Fe_{14}B$ crystal 1.

Also in the $Nd_2Fe_{14}B$ crystal 1, a heavy rare-earth element is enriched in the vicinity of the grain boundary. This is because the heavy rare-earth element (such as terbium Tb) diffuses from the FeCo crystal having a film containing such a heavy rare-earth element (e.g., TbF film) to the $Nd_2Fe_{14}B$ crystal 1.

FIG. 2 depicts an embodiment in which the FeCo crystal has a size larger than that of the NdFeB crystal. FIG. 3 illustrates an embodiment in which the FeCo crystal has a flat shape and is oriented in a specific direction. The FeCo crystal has an average width of the Fe-rich phase of from 10 to 500 nm. When the FeCo crystal has a cobalt concentration of from 5% to 50% and if the FeCo crystal has an average width of the Fe-rich phase of less than 10 nm, it may cause insufficient magnetic coupling between the FeCo crystal and the NdFeB crystal, and this may significantly impair the squareness of the demagnetization curve. In contrast, if the FeCo crystal has an average width of Fe-rich phase of more than 500 nm, it may cause the sintered magnet to have a remarkably low coercivity.

The decrease in the cobalt concentration from the core to the periphery in the FeCo crystal is preferably measured at two or more points in the core and periphery, respectively, in the FeCo crystal; but it can be determined by measuring the cobalt concentrations at not less than one point in the core and periphery, respectively. Here, the term "core" refers to a region of the crystal ranging from the center to about 1-nanometer radius toward the interface.

Example 2

Particles of an alloy containing 70% of Fe, 28% of Co, and 2% of B (percent by weight) are prepared through a rapid solidification process so to have an average particle size of 100 μm, and mixed with a TbF alcohol solution to form a TbF film thereon. The TbF film has an average film thickness of 15 nm. The TbF-coated 70% Fe-28% Co-2% B alloy particles are mixed with a $Nd_2Fe_{14}B$ powder having an average particle size of 1 μm in a solvent without being exposed to the atmosphere. Upon mixing, an organic dispersing agent is further added in an amount of 1%. The TbF-coated 70% Fe-28% Co-2% B alloy particles are used in an amount of 30 percent by volume relative to the $Nd_2Fe_{14}B$ powder. The use of the dispersing agent prevents aggregation of the 70% Fe-28% Co-2% B alloy particles and $Nd_2Fe_{14}B$ powder and enables compact molding of the resulting mixture in a magnetic field. The mixture is compact-molded in a magnetic field of 10 kOe under a load of 2 t/cm$^2$ to give a green compact which includes 70% Fe-28% Co-2% B alloy powder being substantially uniformly dispersed.

The green compact is heated to 1000° C., a magnetic field of 10 kOe is applied during heating and during cooling after sintering, and thereby yields a sintered compact including $Nd_2Fe_{14}B$ crystal grains and 70% Fe-28% Co-2% B alloy particles being adjacent thereto and dispersed. For allowing the sintered compact to have a density of 7.4 g/cm$^3$ or more and to have a remnant flux density of 1.6 T or more, metal alloy particles containing 10 to 90 percent by weight of a rare-earth element are added as a sintering aid. If the sintering aid has a rare-earth element content of less than 10 percent by weight, the sintering aid may fail to form a low-melting-point phase and may not contribute to the improvement in sinterability. If the sintering aid has a rare-earth element content of more than 90 percent by weight, the sintering aid may have an excessively high oxygen concentration and may promote the formation of an acid fluoride compound. This may cause an easy reaction between the matrix and the crystal grains having a high saturation flux density and may cause the sintered magnet to have a lower coercivity.

For the above reasons, preferred as the sintering aid are RE—Fe alloys, RE—Cu alloys, as well as alloys of RE—Al, RE—Ga, RE—Ge, RE—Zn, RE—Fe—Cu, RE—Fe—B, RE—Fe—Co and RE—Fe—Co—B each containing 10 to 90 percent by weight of RE. Here, "RE" is a rare-earth element. The rare-earth element herein may include two or more different rare-earth elements. The sintering aid is preferably a material being resistant to a reaction with a fluoride and having a melting point of from 500° C. to 1000° C. The sintering aid having high reactivity with the fluoride may cause the FeCo crystal to react with the $Nd_2Fe_{14}B$ crystal serving as a main phase to significantly alter the structure and composition of the main phase, and this may cause the sintered magnet to have deteriorated magnetic properties. The addition of any of these alloys as the sintering aid in an amount of 0.01 to 10 percent by weight relative to the weight of the sintered magnet improves sinterability and allows the sintered compact to easily have a density of 7.4 g/cm$^3$ or more. The sintered compact is subjected to a heat treatment and quenching each in a magnetic field. The resulting sintered compact has a remnant flux density of 1.6 T, a coercivity of 25 kOe and a maximum energy product of 62 MGOe as magnetic properties.

Figure 4:
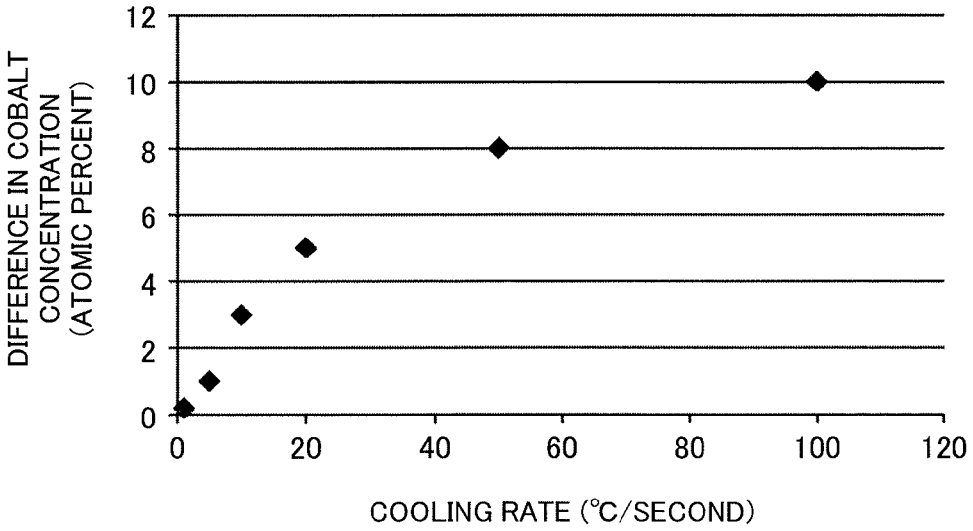
FIG. 4 illustrates how the difference in cobalt concentration varies depending on a cooling rate as examined in the present invention.
Figure 5:
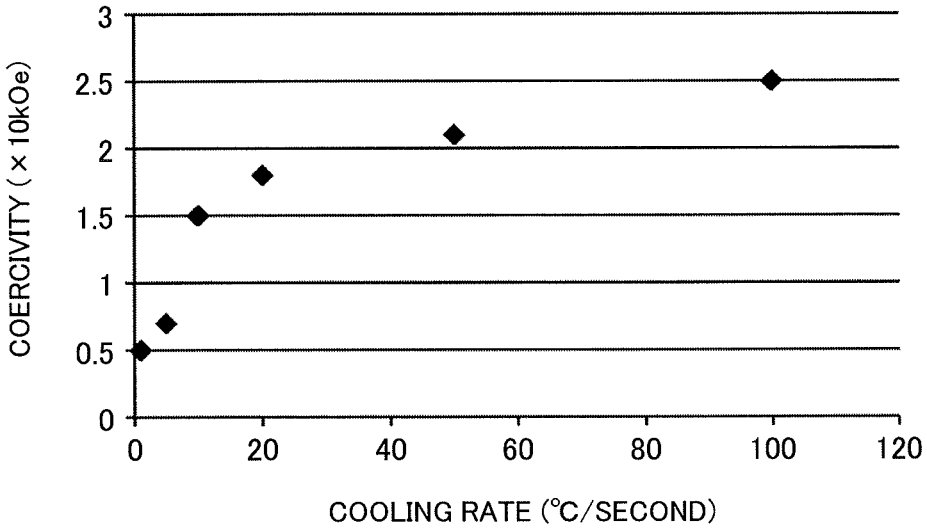
FIG. 5 illustrates how the coercivity varies depending on the cooling rate as examined in the present invention.

FIG. 4 illustrates how the difference in the cobalt concentration varies depending on the cooling rate in the heat treatment in the magnetic field of 20 kOe. The cooling rate is indicated as a maximum rate at temperatures of equal to or higher than the Curie temperature of the FeCo crystal and equal to or lower than the sintering temperature. With an increasing cooling rate, cobalt diffusion tends to be suppressed and the difference in the cobalt concentration tends to increase. FIG. 5 illustrates how the coercivity varies depending on the cooling rate. When the sintered magnet undergoes the cooling at the cooling rate of 10° C./second or more, the sintered magnet has a difference in cobalt concentration of 2 atomic percent or more and can thereby have a coercivity of 10 kOe or more.

Table 1 shows the cobalt concentration and the maximum energy product of the sintered compacts between representative FeCo crystals and $Nd_2Fe_{14}B$ crystals. The sintered compacts each have width of Fe-rich phase (corresponding to the symbol "w" in FIG. 3) of from 25 to 60 nm and can achieve the maximum energy product of from 68 to 75 MGOe.

TABLE 1

Composition of FeCo Crystals and Maximum Energy Product

| Number | Cobalt concentration in Fe-rich phase (atomic percent) | Cobalt concentration in Co-rich phase (atomic percent) | Width w of Fe-rich phase (nm) | Volume fraction of FeCo alloy phase (%) | Maximum energy product (MGOe) |
|---|---|---|---|---|---|
| 1 | 1 | 10 | 50 | 20 | 70 |
| 2 | 2 | 15 | 60 | 25 | 72 |
| 3 | 5 | 20 | 25 | 30 | 75 |
| 4 | 10 | 30 | 40 | 15 | 68 |
| 5 | 20 | 50 | 30 | 20 | 70 |

To exhibit the maximum energy product equivalent to the theoretical maximum energy product of $Nd_2Fe_{14}B$, the sintered compact should satisfy the following conditions.

1) Its main phase which is ferromagnetic includes a $Nd_2Fe_{14}B$ compound and an FeCo alloy.

2) Part of the grain boundary of the FeCo crystal is in contact with a NdOF acid fluoride. Part of the grain boundary of the FeCo crystal is in contact with the crystal of $Nd_2Fe_{14}B$ compound.

3) In the vicinity of the grain boundary of the FeCo crystal, the $Nd_2Fe_{14}B$ compound has an increased cobalt concentration, or the FeCo crystal has a decreased cobalt concentration.

4) FeCo alloy crystals include a crystal containing terbium.

5) A rare-earth-iron compound having a fcc structure or an FeCo crystal having a bcc or bct structure grows in part of grain-boundary triple junctions, and a NdOF or $Nd_2O_{3-x}$ compound, and/or an FeCo crystal phase is observed.

6) The $Nd_2Fe_{14}B$ compound in the vicinity of the FeCo crystal has a terbium concentration higher than the average terbium concentration of the entire sintered compact.

7) The FeCo alloy is a crystal of a bcc or bct structure which contains cobalt and further contains, in addition to Fe and Co, any of other metalloid elements and transition elements and which has a saturation flux density larger than that of the NdFeB crystal.

When the above conditions are satisfied, the sintered compact may give the following advantageous effects.

1) The FeCo alloy has a saturation magnetization higher than that of $Nd_2Fe_{14}B$, and the magnetic coupling of the two phases thereby increases the remnant flux density. The FeCo alloy should contain cobalt in a concentration of from 0.01% to 95% with respect to iron (Fe). Even the FeCo crystal further containing any of other metal elements (e.g., Cr, Mo, Nb, Al, Zr, Zn, Ga, W, Ti, V, Sn, Cu, Ag, Au, Pt and rare-earth elements) and nonmetal elements (e.g., carbon, nitrogen and silicon) in addition to Fe and Co may serve to increase the saturation magnetization, as long as having a saturation magnetization higher than that of $Nd_2Fe_{14}B$.

2) The acid fluoride suppresses the reaction of the FeCoB alloy with the liquid phase upon the sintering, thus prevents the disappearance of the bcc phase having a high saturation magnetization due to the reaction with the $Nd_2Fe_{14}B$ compound, and also prevents coarsening of crystal grains of the $Nd_2Fe_{14}B$ compound.

3) At an interface region between the FeCoB alloy and the $Nd_2Fe_{14}B$ compound, there is observed diffusion between the two phases. Specifically, cobalt diffuses from the vicinity of the grain boundary of the FeCoB alloy into the $Nd_2Fe_{14}B$ compound; and terbium also diffuses into the $Nd_2Fe_{14}B$ compound. In the vicinity of the interface between the FeCoB alloy and the $Nd_2Fe_{14}B$ compound, an Fe-rich phase is observed near to the FeCoB alloy; whereas a Co-diffused phase or Tb-diffused phase is observed near to the $Nd_2Fe_{14}B$ compound. $(Nd, Tb)_2$ $(Fe, Co)_{14}B$ and $Fe_{80}Co_{18}B_2$ are formed. Such $Nd_2Fe_{14}B$ compound containing cobalt and terbium has the Curie temperature increased by 5° C. to 150° C., and an increased magnetocrystalline anisotropy energy with the c-axis direction as an easily-magnetizable direction, or an inclining easily-magnetizable direction. Instead of terbium, the use of any of Dy, Ho, Pr and Sm gives similar effects as above. The c-axis directions serving as the easily-magnetizable direction of the $Nd_2Fe_{14}B$ compound are oriented to one direction in the sintered compact, and the bcc phase has a degree of orientation smaller than that of the $Nd_2Fe_{14}B$ compound. This is because the bcc phase has an anisotropy (anisotropic energy difference depending on crystal direction) smaller than the anisotropy of the $Nd_2Fe_{14}B$ compound, has a direction easily varying during the liquid-phase sintering process, and thereby it is difficult to align the crystal directions as in the direction of the $Nd_2Fe_{14}B$ compound. The application of the magnetic field in the sintering or aging process improves the degree of orientation of the bcc phase, thus the bcc phase grown in a grain boundary phase between two grains has an improved degree of orientation, and part of bcc grains has a <001> direction in parallel with the c-axis direction of the $Nd_2Fe_{14}B$ compound. Such orientation relationship, however, is hardly established in the vicinity of the grain-boundary triple junctions. When the bcc phase is grown as adjacent to the $Nd_2Fe_{14}B$ compound directly or with the medium of a grain boundary layer, helps the sintered magnet to have a higher remnant flux density. In addition, the orientation relationship between the bcc phase and the $Nd_2Fe_{14}B$ compound helps the sintered magnet to have a higher remnant flux density and more satisfactory squareness of the demagnetization curve.

4) An acid fluoride having a cubic or face-centered cubic structure grows in the grain-boundary triple junctions or at the grain boundaries between two crystals and increases the lattice matching in the vicinity of the grain boundary interfaces. The acid fluoride or oxide having a high melting point serves to suppress the reaction between the FeCoB alloy and the $Nd_2Fe_{14}B$ compound. Part of the grain boundaries includes, for example, an amorphous phase, or an orthorhombic crystal, a tetragonal crystal, a rhombohedral crystal, or a hexagonal crystal as formed therein.

5) The Tb-containing fluoride or acid fluoride formed as a result of the solution treatment prevents the reaction of the FeCoB alloy in the sintering heat treatment, and terbium diffuses together with cobalt into the $Nd_2Fe_{14}B$ compound during the sintering. Thus, the sintered magnet has an increased energy product for the following reasons. Specifically, the $Nd_2Fe_{14}B$ compound crystal contains a rare-earth element and cobalt being unevenly distributed; the FeCoB alloy crystal includes a low-Co-concentration phase and the acid fluoride as formed therein; and the $Nd_2Fe_{14}B$ compound crystal containing the unevenly distributed rare-earth element and cobalt is magnetically coupled with the FeCoB alloy crystals containing the low-Co-concentration phase. The low-Co-concentration phase (Fe-rich phase) is a mixed phase of a boride and an FeCoB alloy phase mainly containing a bcc (body-centered cubic crystal) having a cobalt concentration lower than the average cobalt concentration of the FeCoB alloy by 1% to 20% and maintains the lattice matching with crystals having the average cobalt concentration (28%). It is trivial that inevitably contaminated elements such as carbon, nitrogen and oxygen be enriched in part of the crystal grains or at part of the grain boundaries; or that these elements be precipitated as compounds. In addition, it is acceptable that elements or impurities constituting the $Nd_2Fe_{14}B$ compound crystal in the FeCoB alloy migrate into the bcc phase within such ranges as to maintain the bcc structure.

The distribution of the cobalt concentration in the vicinity of the grain boundary between the FeCo crystal and the $Nd_2Fe_{14}B$ compound as in this example may also be achieved by any forming process other than the sintering process such as hot forming, shock-wave forming, plasma sintering, electric-current sintering, instantaneous heating forming, high-magnetic-field forming or roll forming.

Example 3

An alloy containing iron and 10 percent by weight of cobalt is melted in a vacuum, reduced in an atmosphere of nitrogen and 5% of hydrogen, subjected to high-frequency melting, quenched, and thereby yields a foil having a thickness of from 1 to 20 μm and an average particle size of 100 μm. The foil is mixed with a mixture (dispersion) of DyF particles in a mineral oil and pulverized in a bead mill. The DyF particles having a diameter of 0.1 mm are used as the beads. The FeCo crystal powder is controlled to have an average particle size of 5 μm, to the surface of which the DyF particles having a diameter of from 10 to 100 nm are attached. The pulverization is performed by heating the materials in the bead mill at a temperature of 150° C., and this induces mutual diffusion at the boundaries between the DyF particles and the FeCo crystal powder to form a layer of DyF particles on the surface of the FeCo crystal powder. The DyF particles cover the surface in a surface coverage of from 80% to 99%. Next, $(Nd, Pr)_2(Fe, Co)_{14}B$ particles are charged into the bead mill container, and the FeCo crystal powder coated with the DyF film is mixed with the $(Nd, Pr)_2(Fe, Co)_{14}B$ particles without aggregation in such a ratio of the FeCo crystal powder to the $(Nd, Pr)_2(Fe, Co)_{14}B$ particles of 1:1. The resulting mixed slurry is placed in a mold and molded in a magnetic field to give a green compact so as to allow the c-axis direction of the $(Nd, Pr)_2(Fe, Co)_{14}B$ particles to be substantially in parallel with the <001> direction of the FeCo crystal powder. The green compact is placed in a furnace in a reducing atmosphere and is sintered by the application of electromagnetic waves to allow a fluoride and/or an acid fluoride to generate heat. After sintering, the sintered compact is subjected to a quenching heat treatment in a magnetic field and an aging heat treatment in a magnetic field so as to achieve a high coercivity. The sintered compact has an energy product of 80 MGOe, a coercivity of 25 kOe, and a Curie temperature of 950 K as magnetic properties.

The sintered magnet prepared in this example may satisfy the following conditions so as to have a maximum energy product (magnetic property) higher than the theoretical maximum energy product (64 MGOe) of the $Nd_2Fe_{14}B$ sintered magnet.

1) An FeCo crystal having a remnant flux density higher than the saturation flux density (1.2 to 1.6 T) of the $Nd_2Fe_{14}B$ compound grows adjacent to crystals of the $Nd_2Fe_{14}B$ compound. The FeCo crystal mainly includes a bcc structure and has a saturation flux density of from 1.4 to 2.5 T.

2) An FeCo crystal mainly including a bcc structure or a Co-containing alloy having a fcc or hcp structure is magnetically coupled with the $Nd_2Fe_{14}B$ compound so as to have a remnant flux density of from 1.3 to 2.4 T.

3) The FeCo crystals mainly including the bcc structure are dispersed or aggregated in the sintered compact, and such an aggregate of the bcc phase has a size of from 0.001 to 200 μm. An aggregate having a size of less than 0.001 μm may not easily form the magnetic coupling with the crystals of the $Nd_2Fe_{14}B$ compound. An aggregate having a size of more than 200 μm may cause deterioration in squareness of the demagnetization curve. In the aggregates of FeCo crystals, a crystal containing a heavy rare-earth element grows partially.

When the DyF film is formed as in this example, a Dy-rich phase or a Dy-rich crystal grain is observed in the aggregate of the FeCo crystals. This has been formed by part of the DyF film as remaining in the crystal grain of or at a grain boundary of the FeCo crystal during the sintering process. This is identified as a discontinuous Dy-rich crystal in the FeCo crystals through an analysis of every kind. Accordingly, when using a fluoride of a rare-earth element, a rare-earth-rich crystal is observed as surrounded by the aggregates of the FeCo crystals or by the FeCo crystal grains, as in the case where the DyF film or particles are used. The rare-earth-rich crystal has a size in the sintered compact smaller than the average particle size of the FeCo crystals and smaller than the average particle size of the crystal grains of the rare-earth-iron compound having high magnetocrystalline anisotropy. If the rare-earth-rich crystal surrounded by the FeCo crystal grains has a particle size larger than the average particle size of the FeCo crystals, the rare-earth-rich crystal may cause to reduce exchange coupling between the crystals having high magnetocrystalline anisotropy and the FeCo crystals having high saturation flux density. In contrast, if the rare-earth-rich crystal has an excessively large particle size, the rare-earth-rich crystal may cause the sintered magnet to have a lower remnant flux density, because the rare-earth-rich crystal has a small saturation flux density. Herein, the "rare-earth-rich phase" or "rare-earth-rich crystal" has a rare earth concentration larger than $Nd_2Fe_{14}B$ of a main phase, and has a different crystal structure from the $Nd_2Fe_{14}B$.

4) In the FeCo crystals, a region having a high alloy element concentration is observed in the vicinity of the grain boundary (along the grain boundary). The region is formed as a result of mutual diffusion with the $Nd_2Fe_{14}B$ compound. The FeCo crystal has the cobalt concentration decreasing from the core to the periphery (to the vicinity of the grain boundary). The cobalt concentration in the vicinity of the grain boundary is lower than the average cobalt concentration by 1% to 50%. If the difference (decrease) in the cobalt concentration is less than 1%, cobalt does not sufficiently diffuse and does not exhibit the effect of elevating the Curie temperature of the $Nd_2Fe_{14}B$ compound. If the difference (decrease) in cobalt concentration is more than 50%, the sintered magnet may have a varying direction of magnetocrystalline anisotropy and may become susceptible to demagnetization. For these reasons, the FeCo crystals should essentially have a cobalt concentration in the vicinity of the grain boundary lower than the average cobalt concentration in the core by 1% to 50% so as to give an elevated Curie temperature by 5° C. to 100° C. and to give an increased coercivity (5 kOe or more). The variation in cobalt concentration may be determined by an analysis such as transmission electron microscopy-energy dispersive X-ray spectroscopy (TEM-EDX) or secondary-ion mass spectrometry (SIMS).

In the FeCo crystals, such an alloy element is unevenly distributed and has a varying concentration therein, in which part of constitutive elements of the FeCo crystals other than Fe diffuses into crystals of the $Nd_2Fe_{14}B$ compound. In the crystals of the $Nd_2Fe_{14}B$ compound, both an elements other than Fe contained in the FeCo crystals and the heavy rare-earth element are distributed unevenly. Increase in the cobalt concentration helps the $Nd_2Fe_{14}B$ compound to have a higher Curie temperature, and increase in the cobalt concentration and the heavy rare-earth element concentration helps the $Nd_2Fe_{14}B$ compound to have a higher Curie temperature and a larger magnetocrystalline anisotropy energy. The condition may be satisfied also by using any of nitrides, carbides, oxides, borides, and chlorides, and composite compounds of them instead of the fluoride. However, the use of the fluoride gives maximum effect in improvement of the magnetic properties.

Example 4

Particles of an alloy having an average particle size of 50 nm and containing 99% of iron and 1% of cobalt are prepared through atomizing, and a carbon film is formed on the particles. And the resulting particles are immersed in a MgF alcohol solution without being exposed to the atmosphere to form a carbon-containing MgF thin film having an average thickness of 2 nm on the surface of the FeCo crystal grains. The FeCo crystal grains coated with the MgFC film are heated to allow carbon to diffuse into the FeCo particles. The carbon-diffused region in the surface of the FeCo particles includes a fcc (face-centered cubic structure) being stabilized at a high temperature, and the particles contain a mixed phase of the fcc and a bcc (body-centered cubic structure).

By quenching from a temperature of 900° C. at which the fcc structure becomes stable, part of the fcc phase is converted into a bct (body-centered tetragonal structure), and the FeCo particles thereby include the fcc, bct and bcc structures formed therein. Strain is observed among these different crystal structures, strain being introduced due to the difference in the crystal structure. In the particles, the strain tends to increase in the vicinity of the periphery and to decrease in the core. A compact with the strain remaining may be obtained by subjecting the particles to magnetic field orientation and then to compact molding to give a green compact; and binding particles in the green compact with an inorganic material, or forming the green compact at a low temperature of lower than 900° C., or sintering with the addition of a sintered aid. When the particles have the strain of 5% on average in the periphery, the particles may give a sintered magnet having a coercivity of 10 kOe. This sintered magnet has a maximum energy product of 50 MGOe.

If the particles have an average particle size of more than 500 nm, the particles may give a sintered magnet having a coercivity of less than 1 kOe due to decrease in volume fraction of a portion into which the strain is introduced. If the particles have an average particle size of less than 10 nm, the particles may give a sintered magnet having insufficient magnetization due to increased volume fraction of the fcc structure. Accordingly, the optimum range of the average particle size of the particles is from 10 to 100 nm. Within this range, the FeCo particles are in contact with one another with a high strain as a result of forming process. When FeCo particles are in contact with one another thoroughly without space, the sintered magnet is difficult to have a higher coercivity; whereas, when 20% to 95% of the FeCo particles are in contact with one another with a high strain or when the crystal grains coalesce with one another, the sintered magnet has a coercivity of 10 kOe or more. The MgF film serves as a film for carbon supply and is necessary for prevention of oxidization of the particles, stabilization of the crystal structures of the respective phases, and introduction of the strain.

As is described above, the following conditions may be satisfied to achieve a maximum energy product of 50 MGOe without using a rare-earth element.

1) The particles containing iron and cobalt elements and having the average particle size of from 10 to 100 nm have the strain of 5% or more in the periphery of the particles, in which 20% to 95% of the surface area of each particle is in contact with adjacent another particle through grain boundary regions, the particles has a tetragonal structure which is different from cubic structures such as bcc structure in the particles, and the lattice strain tends to be large in the vicinity of the periphery and to be small in the core of the particles. The strain may be introduced by forming an alloy having an absolute value of magnetostriction constant of $1\times10^{-5}$ or more in the particles containing iron and cobalt elements and applying a magnetic field thereto to introduce the strain. Or the strain may be imparted by a lattice deformation caused by subjecting the resulting article to a heat treatment after forming an alloy or compound that transforms with the lattice deformation at a temperature from −70° C. to 700° C. In either technique, the lattice strain or the lattice deformation for changing the crystal structure in an amount of from 5% to 20% can be introduced from the outer periphery of the particles. This allows the sintered magnet to have the coercivity higher than that in the absence of the strain by 5 kOe or more. Introduction of the lattice strain of more than 20% is possible, but such excessively large lattice strain may unstabilize the lattice and may impede formation of a magnet which is usable at temperatures of 200° C. or higher. Exemplary effective high-magnetostriction alloys include $Fe_2TiO_4$; and exemplary effective lattice deformation alloys include NiMnGa alloys. Alternatively, the lattice deformation due to the magnetic coupling may be used, the lattice deformation being formed by utilizing a transformation temperature typically of magnetic transformation or order-disorder transformation due to formation of a Heusler alloy containing cobalt at the grain boundary or in the grain.

2) A fluorine compound, an acid fluoride compound or a hydride is used to suppress oxidation of microparticles and nanoparticles, and the green compact (molded article) includes an acid fluoride compound.

3) Crystal grains which have a high concentration of a constitutional element of the fluoride are formed in the vicinity of the grain boundary of the particles containing iron and cobalt elements and having the average particle size of from 10 to 100 nm. The concentration of the constitutional element of the fluoride is 1.1 to 1000 times as high as the average concentration of surroundings, and such high concentration is caused by enrichment of the constitutional element accompanied with the diffusion or crystal grain growth during the sintering process.

4) The strain with the lattice deformation should be introduced into 50% or more of the periphery of the crystal grains, i.e., into 50% or more of an outermost peripheral crystal surface area where the crystal lattices of crystal grains are matched. The strain introduced into less than 20% of the area does not substantially affect the coercivity; and the strain introduced into 20% to 50% of the area may contribute to increase in the coercivity, but the increase is less than 5 kOe. In a preferred embodiment, crystals having the lattice strain of from 5% to 20% grow in the outer periphery of ferromagnetic crystal grains while maintaining machining or partial matching with the core of the crystal grains, and these crystals having the lattice strain occupy 50% or more of the surface area of an outer peripheral surface of the crystal grains having a similar composition to that of the core of the crystal grains. The resulting sintered magnet can have a coercivity of 10 kOe or more. In addition, directions of the lattice strains are aligned, and anisotropy is applied to the crystal grain orientation. By this, the sintered magnet can have a further higher coercivity and a further higher remnant flux density and can have a maximum energy product of 50 MGOe without using a rare-earth element. Even when atoms such as carbon, nitrogen, oxygen, fluorine, chlorine and boron are arranged in interatomic positions in portions with lattice strains, similar magnetic properties to above can be obtained.

Example 5

An alloy containing 70% of iron, 25% of cobalt, and 5% of terbium is heated and vaporized in vacuo, and nanoparticles of the vapor are deposited to the inner wall of a vacuum chamber. During vaporization, $NHF_4$ gas is introduced to form nanoparticles containing fluorine in the outer periphery of them. The resulting nanoparticles (powder) are mixed with a NdFeB powder and transferred from the vacuum chamber into a mold without being exposed to the atmosphere. The two different magnetic powders placed in the mold are compact-molded while applying a magnetic field thereto, and thereby yield a green compact. The green compact is sintered by heating and thereby yields a sintered compact having a density of from 7.3 to 7.7 g/cm$^3$.

The application of the magnetic field upon the sintering allows crystal grains of FeCoTb alloy to orient to a direction of a magnetic field application, and the flux density can be maximized in a direction corresponding to the direction. Such sintering in the magnetic field is effective because the FeCoTb alloy has the Curie temperature higher than the sintering temperature. When the 70% Fe-25% Co-5% Tb alloy has the particle size of 30 nm and the NdFeB powder has the average particle size of 1 μm, the green compact can be sintered at a temperature of 900° C.; whereas the 70% Fe-25% Co-5% Tb alloy has the Curie temperature of 930° C. Accordingly, the orientation of the 70% Fe-25% Co-5% Tb alloy powder or the arraying/growth directions of the nanoparticles can be aligned to the direction of the magnetic field by applying the magnetic field at a temperature higher than the Curie temperature of the NdFeB powder and lower than the sintering temperature. In a more preferred embodiment, the magnetic field of from 10 kOe to 200 kOe is applied at the temperature in the range of from 500° C. to 900° C. Thus, the particle growth direction and the particle arraying direction of the 70% Fe-25% Co-5% Tb alloy or the growth orientation of the particles is oriented along the direction of the magnetic field, and this gives a sintered magnet having a remnant flux density being maximized in the direction of the magnetic field applied upon the sintering.

The coercivity varies depending on the magnetocrystalline anisotropy energy of the NdFeB crystal grain. Prior to sintering, a fluoride containing terbium grows in the vicinity of the particle surface due to the reaction with the $NHF_4$ gas, because terbium has been added; and the fluoride suppresses the diffusion between the FeCoTb alloy and the NdFeB crystal grains upon the sintering. During the sintering, terbium and cobalt diffuse into the NdFeB crystal grains and are present in high concentrations in the outer periphery of the NdFeB crystal grains. Thus, the sintered magnet has a larger magnetocrystalline anisotropy energy and a higher coercivity.

When the volume ratio of the FeCoTb alloy particles to the NdFeB crystal grains is 1:4, the sintered magnet has a remnant flux density of 1.5 T and a coercivity of 20 kOe as magnetic properties. A sintered magnet prepared without the application of a magnetic field upon sintering has a lower remnant flux density of 1.4 T. The application of the magnetic field upon the sintering helps the sintered magnet to have more satisfactory magnetic properties. This is because the particles of the FeCoTb alloy can be maintained by the action of the fluorine-containing phase without diffusion/disappearance of FeCo particles having the Curie temperature equal to or higher than the sintering temperature; and the FeCo crystals can be aligned in substantially parallel with the direction of the magnetic field, the FeCo crystal having the remnant flux density higher than that of the NdFeB crystals.

In the sintered compact, the fluoride is present in a larger amount at a boundary region with the FeCoTb alloy than at a boundary region with the NdFeB crystal grain. The FeCoTb crystals formed around the NdFeB crystal grain have lower magnetic coupling among the FeCoTb crystals due to the presence of the fluoride and have a larger coercivity due to suppression of propagation of magnetization reversal. Thus, the sintered compact has more satisfactory heat resistance. For more satisfactory heat resistance, therefore, the fluoride in contact with the FeCo crystals should be present in a contact area or volume larger than that of the fluoride in contact with the NdFeB crystals. When the fluoride is formed only on a boundary region with the NdFeB crystal, the FeCo crystal is more liable to propagate the magnetization reversal to an adjacent FeCo crystal, and this may cause the sintered magnet to have a lower coercivity. A local orientation relationship is observed between the crystal orientation of the FeCo crystals and the crystal orientation of the NdFeB alloy. However, the effect of increasing the remnant flux density can be obtained even when no orientation relationship is observed.

The sintered compact (sintered magnet) includes NdFeB crystals, FeCo crystals, an acid fluoride and a fluoride. The sintered compact has a volume fraction of the acid fluoride and fluoride of from 0.01% to 1%. If the sintered compact has a volume fraction of these compounds of more than 10%, the sintered compact may have a lower energy product. As constitutional phases other than above, the sintered compact includes a boride, a carbide, an oxide, and a rare-earth-rich phase containing 40 percent by weight or more of a rare-earth element, as grown therein. In addition, metal elements such as Cu and Zr are enriched in the vicinity of grain boundaries. In an embodiment, an alloy phase containing a constitutional element of the main phase such as a Cu—Nd alloy or an Al—Nd alloy is formed at the grain boundary. This improves the sinterability.

In such constitutional phases other than the NdFeB crystals and FeCo crystals, the volume fraction of a fluorine-containing phase is smaller than that of a phase containing no fluorine. If the volume fraction of the fluorine-containing phase is larger than that of the phase containing no fluorine in constitutional phases other than the NdFeB crystals and FeCo crystals, the sintered compact may have an insufficient density due to insufficient sinterability, may hardly have a higher maximum energy product and may have a lower coercivity.

Other alloys than NdFeB alloys such as Heusler alloys (e.g., SmCo, SmFeCo and MnAl alloys), ferrite alloys and AlCoNi alloys may be composited with FeCo crystals with the fluoride or the acid fluoride utilizing the high flux density thereof as in this example. These alloys also exhibit effects of increasing the maximum energy product.

Instead of the sintering process employed in this example, use can be made of various forming/processing processes such as warm forming, hot forming, hot extrusion molding, shock-wave forming, cold forming, stretch forming, electric-current forming, forming using a ball mill or a bead mill, or agitation friction, forming by electromagnetic heating, injection molding, compact molding, isostatic molding, and quenching roll forming.

Example 6

Particles having a composition of 90% of iron and 10% of cobalt and having an average particle size of 2 nm are mixed with an alcohol solvent, and further mixed with a TbF sol to give a slurry. The mixed slurry is combined with a dispersing agent and thereby yields a low-viscosity slurry. A green compact including a NdFeB powder is impregnated with the low-viscosity slurry, the solvent is removed from the green compact, and the resulting article is sintered by heating. Impregnation of cracks (gaps) in the green compact with the slurry is difficult if the particles have an average particle size of 100 nm or more; but it becomes possible when the particles have an average particle size of 10 nm or less. Thus, the nanoparticles can be attached to the NdFeB alloy powder and to the surfaces of the cracks in the powder with the medium of a TbF film.

The application of the magnetic field of 10 kOe or more upon the sintering allows the FeCo nanoparticles to be oriented in the direction of the magnetic field. For promoting the orientation of the nanoparticles by the action of the magnetic field, an alternating magnetic field of from 10 kOe to 20 kOe is applied at a low temperature prior to the formation of a liquid phase so as to allow the nanoparticles to move in the cracks. In addition, a direct-current magnetic field is applied after the formation of the liquid phase so as to allow the nanoparticles to align along the direction of the magnetic field in the liquid phase without aggregation.

The formation of the TbF film suppresses an easy diffusion reaction of the FeCo nanoparticles before sintering with the NdFeB alloy powder. After the sintering, terbium diffuses from the TbF film into the NdFeB alloy and is enriched in the vicinity of a grain boundary in the NdFeB alloy. Part of cobalt atoms diffuses into the NdFeB alloy to thereby allow the NdFeB alloy to have a higher Curie temperature. In addition, a magnetic field is applied also during aging after sintering. This promotes atomic rearrangement at the grain boundaries in the vicinity of the FeCo nanoparticles and thereby enhances the magnetic coupling of the NdFeB alloy crystals with the FeCo nanoparticles, or assemblies (aggregates) thereof, or FeCo crystals formed through coalescence and growth of the FeCo particles. The resulting sintered magnet can have the coercivity higher than that in the sintered magnet prepared without the application of the magnetic field by 2 to 5 kOe.

The sintered magnet according to this example has magnetic properties of the maximum energy product of 60 MGOe and the coercivity of 30 kOe when prepared through repeating impregnation with the slurry to a volume of the 90% Fe-10% Co particles of 10%. The sintered magnet is thereby usable as various magnetic circuits typically in rotators, magnetic resonance imaging (MRI) systems, and vibrating coil magnetometers (VCM). Sintered magnets having equivalent performance to that in this example can also be obtained by impregnation with a rare-earth fluoride solution containing Fe and Co, the impregnation of the rare-earth fluoride nanoparticles with the solution containing Fe and Co, or hot forming instead of the sintering after the impregnation. In addition or alternatively, any of grain boundary diffusion processes and/or formation of a surface protective film may be performed after the sintering.

In this example, the FeCo crystal grains are dispersed on average among crystal grains of the NdFeB alloy. Part of the FeCo crystal grains aggregate, but continuation of such aggregates from one surface of the sintered compact to the other should be avoided. The formation of FeCo crystal grains as dispersed in NdFeB alloy crystal grains ensures magnetostatic coupling and exchange coupling between the FeCo crystal grains and the NdFeB crystal grains and breaks the continuity of magnetic domain walls among the NdFeB crystal grains. It is important that FeCo crystal grains are dispersed so as to avoid the formation of the NdFeB alloy crystal fully covered with the FeCo crystal grains, because such a NdFeB crystal grain fully covered with FeCo crystal grains does not so satisfactorily contribute to improved magnetic properties.

Example 7

Nanoparticles containing 66% of iron and 34% of cobalt are formed from a solution so as to have a particle size of 3 nm. The nanoparticles are allowed to adsorb oxygen on their surface through introduction of oxygen and heated until the growth of $CoFe_2O_4$ is observed in part of the surface. Cubic crystals are formed in the core of the nanoparticles, and there is formed the magnetic coupling between the core and the oxide in the periphery.

If a sintered magnet has a surface coverage of $CoFe_2O_4$ of less than 10%, the sintered magnet has a coercivity of less than 1 kOe. However, the sintered magnet has the coercivity of from 1 to 10 kOe at the surface coverage of from 10% to 30%; the coercivity of from 10 to 20 kOe at the surface coverage of from 30% to 50%; and the coercivity of about 20 kOe at the surface coverage of 50% or more. An FeCo crystal phase having a bcc or bct structure grows in the core of the nanoparticles; and the sintered magnet has an increasing remnant flux density with an increasing volume fraction of the FeCo crystal phase. Such a sintered magnet can be prepared by mixing the FeCo nanoparticles which have been covered with $CoFe_2O_4$ on the surface with a solvent (dispersion medium) to give a mixture, placing the mixture in a mold, compact-molding the mixture upon the application of a magnetic field to give a green compact, and heating and sintering the green compact.

A MgF solution is applied to the nanoparticles after oxidization to form a MgF film thereon (wherein X is a positive number) to thereby remove excessive oxygen. This stabilizes the structure of a $CoFe_2O_4$ layer having a thickness of less than 1 nm on the surface of the nanoparticles. In addition, a film of $M_nF_m$ or $M_n(OF)_m$ is formed to a thickness of 0.1 to 10 nm (wherein M represents a metal element; F represents fluorine; O represents oxygen; and n and m denote positive numbers). This helps the nanoparticles to have heat resistance increased by 100° C. to 300° C. Thus, the sintered magnet can have a coercivity of 20 kOe and a remnant flux density after the forming of from 0.7 to 1.7 T. The particle size is one of important factors for ensuring satisfactory magnetic properties and should be less than 100 nm. Because it may be difficult to allow the sintered magnet to have the coercivity of 10 kOe or more if the particle size exceeds 100 nm. It is difficult to uniformize diameters of the particles, and the particle sizes have some distribution. The particles for use herein should therefore have an average particle size of 50 nm or less, while contamination of particles having a particle size of 100 nm or more should be avoided. If the particles have the average particle size of less than 2 nm, the volume of the FeCo crystals in the particles is smaller than that of the acid fluoride present in the outermost surface or periphery of the particles, and the resulting particles become thermally unstable. For these reasons, the particles preferably have the average particle size of from 2 to 50 nm.

The magnet according to this example is a magnet using FeCo crystal particles having the average particle size of from 2 to 50 nm. The magnet includes the FeCo crystal, an Fe-containing oxide, an acid fluoride, and inevitable compounds. The FeCo crystal is present in the core of the crystal grain or magnetic powder; the Fe-containing oxide is present in the periphery of the crystal grain or magnetic powder; and the acid fluoride grows in the outermost periphery thereof. The FeCo crystal occupies the largest volume fraction, followed by the Fe-containing oxide and the acid fluoride in this order. The Fe-containing oxide covers the surface or grain boundary in coverage of 30% or more. Cobalt is added to the FeCo crystal and to the Fe-containing oxide. The addition of cobalt suppresses the growth of $Fe_3C$ and other non-magnetic compounds and fcc-Fe. Typically, the addition of cobalt in the amount of 10% allows the sintered magnet to have a saturation flux density increased by 0.2 to 0.4 T. Cobalt is partially unevenly distributed (and enriched) in the Fe-containing oxide or FeCo crystal grains. By performing such a heat treatment as to allow the cobalt concentration to be largest in the Fe-containing oxide, the sintered magnet can have the coercivity further increased by 1 to 5 kOe.

Any of metal elements and metalloid elements may be added to the FeCo crystal within a range not forming a non-magnetic phase. In another embodiment, such a metal element or metalloid element is brought into contact with the FeCo crystal and/or the Fe-containing oxide to form a magnetostriction material or a material which undergoes crystal structure change (phase transition) at a temperature of from 300° C. to 900° C. This induces a lattice strain of 0.1% or more in the vicinity of the boundary interface and thereby allows the sintered magnet to have the coercivity further increased by about 5 kOe. The sintered magnet according to this example without the formation of the acid fluoride has the coercivity of 500 Oe or less and the saturation magnetization of higher than 200 emu/g and is thereby usable as an electromagnetic-wave absorber.

Example 8

By vaporizing $NdF_3$ and an alloy containing 50% of iron and 50% of cobalt, particles having an average particle size of 10 nm and including a mixed phase of the 50% Fe-50% Co alloy and $NdF_3$ are prepared. The particles are irradiated with electromagnetic waves and then quenched. The irradiation causes $NdF_3$ to generate heat, and this elevates the temperature of the vicinity of the grain boundary to a range of from 500° C. to 1000° C. The subsequent quenching performed at a cooling rate of 100° C./second allows a lattice strain to form and allows a metastable phase to grow both in the boundary region. As used herein the term "boundary region" refers to and includes both a boundary interface itself and a region along the boundary face within a distance of 2 nm from the boundary interface. That is, the boundary region is a layer having a thickness of 4 nm. Examples of the "metastable phase" include FeCo crystals having a bct structure; as well as FeCo crystals, Nd—F compounds, Nd—O—F compounds, Nd—Fe—Co—F compounds and Nd—Fe—Co—O—F compounds each having a lattice strain of from 1% to 25%. Such alloys or compounds having a lattice strain within the above range have crystal symmetry different from that of a stable phase and have higher magnetocrystalline anisotropy. Forming of these magnetic powders at a temperature of lower than 500° C. in a magnetic field gives a magnet sintered compact (sintered magnet) having a maximum energy product of from 20 to 60 MGOe with the lattice strain remaining.

Conditions for obtaining a magnet having these properties are as follows.

1) FeCo particles having an average particle size of from 5 to 100 nm are used. If a sintered magnet uses FeCo particles having an average particle size of less than 5 nm, the sintered magnet may have a maximum energy product of less than 20 MGOe due to increased proportions of iron and cobalt atoms to undergo diffusion reaction with a fluoride. If the sintered magnet uses FeCo particles having an average particle size of more than 100 nm, the sintered magnet may have a low maximum energy product of less than 20 MGOe due to a low coercivity, because the proportions of iron and cobalt atoms having a lattice strain decrease, atoms being introduced in the vicinity of the boundary region with the fluoride.

2) A lattice strain to be introduced into an FeCo crystal in the vicinity of a boundary face with the fluoride is from 1% to 25%. As used herein the term "vicinity of the boundary interface" refers to and includes both a boundary interface itself and a region which is within a distance of 3 nm from the boundary interface and which is along the boundary interface. If the lattice strain is less than 1%, the sintered magnet may have a coercivity increased by less than 5 kOe even due to increased magnetocrystalline anisotropy and easily undergoes magnetization reversal due to thermal demagnetization. The lattice strain of from 1% to 25% gives a magnet having a coercivity increased by 10 kOe or more, and the resulting magnet can be used at temperatures of from 20° C. to 200° C. In contrast, if the lattice strain is more than 25%, the FeCo crystal may have inferior stability in crystal structure, and this may cause the sintered magnet to have a low coercivity and inferior reliability upon forming, thus being undesirable. When the lattice strain is introduced into the FeCo crystal, the a-axis shrinks whereas the c-axis stretches; or the a-axis does not change whereas the c-axis stretches; or the a-axis stretches whereas the c-axis also stretches more than the a-axis does. The sintered magnet may have not so significantly deteriorated magnetic properties even when various interstitial elements are arranged in the strain field or any other metal element is substituted on the iron or cobalt atomic position, as long as the concentration of them is 20% or less. A crystal having such a lattice strain has one or more of bct (body-centered tetragonal) structure, fct (face-centered tetragonal) structure, rhombohedral structure, and hexagonal structure.

3) The boundary interface between the FeCo crystal and the fluorine-containing compound partially includes a coherent boundary interface. The FeCo crystal has a crystal orientation relationship with the fluorine-containing compound. In the FeCo crystal grains, an ordered phase grows in the core, whereas a disordered phase grows in the vicinity of a boundary interface between the fluorine-containing compound and the FeCo crystal into which a lattice strain has been introduced through quenching effect. The ordered phase and the disordered phase in the FeCo crystal have matching with each other.

4) The FeCo crystal having a tetragonal structure has a lattice into which two or more different elements invade, where an ordered structure including Fe and Co, and two or more interstitial elements being regularly aligned is observed. The ordered structure helps the sintered magnet to have a higher magnetocrystalline anisotropy constant and to thereby have a coercivity of 10 kOe or more.

5) Part of the FeCo crystals is an alloy in which one or more metal elements (e.g., Mo, Ti, Nb, V, Zr, Mn and Ni) other than iron and cobalt replace the iron and/or cobalt atomic position, and some of the metal elements have a short-range ordered structure.

Example 9

A porous aluminum metal having interconnected pores is prepared typically by bubbling a gas into molten aluminum. Independently, a slurry is prepared by coating the surface of FeCo crystal nanoparticles with a fluoride and precipitating them in an alcohol solvent. The slurry is injected into the interconnected pores of the porous aluminum metal. By repeating the injection, the interconnected pores are filled with and plugged with the FeCo crystal nanoparticles, and the resulting article is heated and molded in a magnetic field and thereby yields a compact. An anisotropic magnet having a maximum energy product of from 20 to 50 MGOe can be obtained by controlling the density and size of the interconnected pores through bubbling conditions so as to allow the FeCo nanoparticles to occupy the sintered compact in a volume fraction of 60%. In an embodiment, fluoride-coated FeCo nanoparticles are mixed with aluminum to give a mixture, the mixture is subjected to bubbling in a magnetic field upon the preparation of the porous aluminum metal, the resulting article is further impregnated with the fluoride-coated FeCo nanoparticles, and heated and formed to give a sintered magnet. The resulting magnet (compact) can have a volume fraction of the FeCo nanoparticles of from 50% to 80% and has a maximum energy product of from 40 to 60 MGOe. The process may employ any of $Nd_2Fe_{14}B$ alloys, AlNiCo alloys, FeCrCo alloys, MnAl alloys, SmCo alloys, ferrimagnetic alloys and antiferromagnetic alloys instead of aluminum. And the process may employ any of FeCoM crystals wherein M represents a metal or metalloid element other than Fe and Co instead of the FeCo crystals.

Example 10

Particles of an alloy containing 70% of iron and 30% of cobalt are formed by high-frequency plasma process so as to have an average particle size of 30 nm and are placed in a MgF solution without being exposed to the atmosphere. Thus, a MgF film having an average thickness of 1 nm is formed on the surface of the 70% Fe-30% Co alloy particles. The resulting particles are subjected to warm forming in a magnetic field to give a compact. The compact has a density of about 80%. This compact has such a density as to allow the presence of interconnected pores penetrating the compact from one surface to the other and has anisotropy imparted by the magnetic field. The warm forming is performed at a temperature of 200° C. in a magnetic field of 10 kOe under a load of 10 $t/cm^2$. The compact is impregnated in its interconnected pores with a SiO solution, dried to form a SiO film thereon, and heated to a temperature of from 300° C. to 600° C. This allows an acid fluoride to grow between the MgF film and the SiO film. Quenching from a temperature in the range of from 500° C. to 700° C. allows the metastable phase to remain even down to room temperature, allows a lattice strain to form in the vicinity of the acid fluoride, and introduces a lattice strain of from 0.1% to 20% also to the surface of particles of the 70% Fe-30% Co alloy. The amount of the lattice strain to be introduced may vary depending on the diameter and composition of the particles, thicknesses and compositions of the oxide, fluoride, and acid fluoride, the crystal structure, orientation relationship, and lattice matching in the vicinity of a boundary face. The introduced lattice strain helps the 70% Fe-30% Co alloy particles to have an increased coercivity up to 25 kOe at maximum. The 70% Fe-30% Co alloy particles in this case have a remnant flux density of 1.5 T.

To satisfy these magnetic properties, the following conditions should be satisfied.

1) The ferromagnetic particles are FeCo crystals.

2) The particles have an average particle size of 100 nm or less and 10 nm or more.

3) The particles bear on their surface a fluoride, an oxide or an acid fluoride.

4) The crystal lattice of the particles on their surface is strained.

These conditions will be described in further detail below.

1) The FeCo crystal has a saturation flux density of 1.7 T or more and up to 2.4 T at maximum. For this reason, an alloy having such a composition including pure iron added with cobalt can have a higher saturation flux density and a higher remnant flux density. In particular, an FeCo crystal containing 1% to 50% of cobalt can have a remnant flux density of from 1.4 to 1.8 T.

2) If the particles have a particle size of more than 100 nm, the particles may fail to give a coercivity of 25 kOe or more, because the number of atoms affected by the lattice strain decreases, and a magnetization reversal region is liable to form by the action of a lattice with a small lattice strain. In contrast, if the particles have a particle size of less than 10 nm, the particles may suffer from decrease in remnant flux density, because of an increased volume fraction of the oxide and/or fluoride formed in the particle surface.

3) A surface layer capable of preventing oxidation of the FeCo crystals and introducing a lattice strain is any of a fluoride, an oxide and an acid fluoride. Such compounds are easily formed by a treatment with a solution, and the coverage of which can be 70% or more when an organic dispersing agent is added for the prevention of aggregation. Part of the compounds undergoes diffusion with FeCo crystal grains and thereby contains iron and/or cobalt in the vicinity of a boundary face. In addition, part of the surface layer maintains a crystal orientation relationship with a matching relationship with the FeCo crystal grains and introduces a lattice strain into the FeCo crystals. In another embodiment, any of additive elements is added to the FeCo crystals. Also in this embodiment, a diffusion layer containing the added element and a lattice-matched layer are formed in the vicinity of the boundary interface, and a lattice strain can be introduced into the crystals.

4) A diffractometry typically of electron diffraction or X-ray diffraction of the sintered magnet according to this example reveals that a lattice strain of from 0.1% to 20% on average is introduced in the vicinity of the particle surface. A lattice strain of less than 0.1% may cause a low coercivity of less than 1 kOe, and the sintered compact may fail to serve as a hard magnetic material. A coercivity of more than 1 kOe can be obtained at a lattice strain of 0.1%, and the coercivity can increase with a further increasing lattice strain. Introduction of a large lattice strain may be performed typically by any of the following techniques. Specifically, an interstitial element such as carbon, nitrogen, or fluorine atom is added to FeCo crystals; such an element as Cr, Ba, Nb, V, Zr, Ga, Bi, Mn, Ni, Ti, Mo, Ta, W, Al or Cu is added to the FeCo crystals to induce composition modulation in the particles, a phase is formed in the core or in the vicinity of the surface of the FeCo crystals, the crystal structure of which phase transforms, and the strain is introduced into the FeCo crystals, the strain being caused by phase transformation upon heat treatment, or the FeCo crystals are combined with such an element as to readily diffuse with the oxide, fluoride or acid fluoride formed in the outermost surface, and the lattice strain is introduced which is caused by a lattice constant distribution due to the formation of a diffusion layer through heating or due to the distribution of concentration of the added element.

Example 11

An alloy containing iron and 10% of cobalt is vaporized by a plasma process, formed in a magnetic field into particles having a ratio of major axis to minor axis of 1.5 or more and 100 or less (1.5 to 100) and an average diameter in minor axis direction of 20 nm, a solution of a fluoride having a composition of $TbF_{2.5}$ in an alcohol is applied to the particles, dried, and heated. The particles are placed in a mold, to which a magnetic field is applied to align the major axis directions, and a load of 1 to 20 t/cm$^2$ is applied at a temperature of from 100° C. to 850° C., and thereby yields a compact. The compact has a volume fraction of the Fe-10% Co alloy of from 80% to 99% and is a hard magnetic material having a remnant flux density of 1.8 T and a coercivity of from 1 to 20 kOe. A magnet having a further higher coercivity of from 10 to 30 kOe can be obtained typically by reprocessing the compact to increase lattice strains on the FeCo crystals, or by adding a metal element of various kind to increase the strain of crystal lattice, mixing with $Nd_2Fe_{14}B$, $SmCo_5$ or another compound containing a rare-earth element as a third phase, and subjecting the mixture to hot forming.

To obtain a magnet having a remnant flux density of 1.5 T or more as magnetic properties, the following conditions may be satisfied.

1) The FeCo particles do not have a spherical shape but have spherical anisotropy and are covered with a fluoride or acid fluoride in a coverage of 50% or more based on the total surface area. If the coverage is less than 50%, the resulting magnet may have insufficient magnetization due to oxidation of the FeCo particles and thereby have deteriorated magnet properties. If the FeCo alloy particles have the average particle size in the minor axis direction of less than 1 nm, the FeCo alloy particles may not help to ensure a satisfactory coercivity. In contrast, if the FeCo alloy particles have an average particle size in the minor axis direction of more than 500 nm, the FeCo alloy particles may cause the magnet to be susceptible to magnetization reversal. To avoid these, the average particle size in the minor axis direction is preferably from 1 to 200 nm.

2) The fluoride or acid fluoride occupies 0.01 to 2 percent by volume of the compact. If the fluoride or the acid fluoride occupies less than 0.01 percent by volume, the fluoride or the acid fluoride may fail to cover the surface in coverage of 50% or more. If the fluoride or the acid fluoride occupies 10% or more in volume fraction, the compact may suffer from significant reduction in magnetization due to such non-magnetic fluoride. To avoid these, the volume fraction of the fluoride or the acid fluoride is optimally from 0.01 to 2 percent by volume.

3) A lattice strain or a variation in atomic position is observed in the outermost surface of the FeCo particles. The lattice strain of from 0.1% to 20% is present in the crystal lattice in the outermost surface. The acid fluoride and FeCo particles have cubic crystal structures, and the lattice strain is introduced between cubic crystal lattices. For the introduction of such lattice strain, quenching at a cooling rate of 10° C./second in a temperature range of 400° C. or higher is effective.

Exemplary materials to be mixed with the fluoride-coated FeCo particles to improve magnet properties include $Nd_2Fe_{14}B$ alloy powder, as well as $SmCo_5$, $Sm_2Co_{17}$ and other compounds containing a rare-earth element; ferrite powders; antiferromagnetic powders; and ferrimagnetic powders. The resulting mixture is subjected to orientation or heat treatment each in a magnetic field at a temperature of 500° C. or higher. This allows the FeCo particles to have increased shape anisotropy and to have increased the magnetic coupling with the added powder, and this contributes to improvements in coercivity, remnant flux density, and squareness of the demagnetization curve. In addition, $Nd_2Fe_{14}B$ particles and $SmCo_5$ or $Sm_2Co_{17}$ particles are mixed, subjected to magnetic field orientation and then to sintering. Thus, samarium (Sm) and cobalt are unevenly distributed and enriched in the vicinity of the surface of the $Nd_2Fe_{14}B$ particles and thereby allow the easily-magnetizable direction of the $Nd_2Fe_{14}B$ particles to incline by 1 to 90 degrees in the vicinity of the surface. This suppresses magnetization reversal and thereby helps the magnet to have the coercivity increased by 1 to 10 kOe. Thus, the inclination of the easily-magnetizable direction of the matrix $Nd_2Fe_{14}B$ crystals in the vicinity of boundary interfaces is effective to increase the coercivity. The inclination may be performed in a magnitude of 1 degree or more, and preferably 10 degree or more with respect to the easily-magnetizable direction of the matrix not unevenly distributed. For continuous inclination of the easily-magnetizable direction from the core to the grain boundary in the matrix particle, it is important to control the distribution of the unevenly-distributed element concentration and to control atomic vacancy concentration. Thus, the process should be controlled so that concentration gradients of samarium and cobalt are observed in a region within 200 nm from the grain boundary face. For having an increased coercivity and for ensuring satisfactory energy product, a steep concentration gradient is desirably observed in the vicinity of a grain boundary interface in a depth of from 0.1 nm to 200 nm from the grain boundary interface. In contrast, enrichment of samarium and cobalt in the particles in the core in a depth of more than 200 nm from the grain boundary face may cause the magnet to have inferior magnetic properties.

What is claimed is:

1. A sintered magnet comprising:

a NdFeB crystal;

an FeCo crystal; and a grain boundary region disposed between the NdFeB crystal and the FeCo crystal, wherein the FeCo crystal has a cobalt concentration decreasing from a center to an interface by 2 atomic percent or more, and wherein the NdFeB crystal contains cobalt and a heavy rare-earth element, and has concentrations of the cobalt and the heavy rare-earth element increasing from a center to an interface.

2. The sintered magnet according to claim 1, wherein the FeCo crystal includes a body-centered cubic structure or a body-centered tetragonal structure.

3. The sintered magnet according to claim 1, wherein the FeCo crystal has a saturation flux density higher than the saturation flux density of the NdFeB crystal.

4. The sintered magnet according to claim 1, wherein the grain boundary region has a width of 0.1 to 2 nm.

5. The sintered magnet according to claim 1, wherein the grain boundary region includes an acid fluoride.

6. The sintered magnet according to claim 1, wherein the heavy rare-earth element is enriched at the grain boundary region.

7. The sintered magnet according to claim 1, wherein the NdFeB crystal has a degree of orientation higher than the FeCo crystal.

8. The sintered magnet according to claim 1, being prepared through quenching in a magnetic field at a cooling rate of 10° C./second or more in a heat treatment process upon sintering.

* * * * *